United States Patent [19]

Fitzgibbon

[11] 4,089,085

[45] May 16, 1978

[54] SASH BALANCES AND COMPONENTS THEREOF

[75] Inventor: Jack R. Fitzgibbon, Sioux Falls, S. Dak.

[73] Assignee: Balance Systems, Inc., Sioux Falls, S. Dak.

[21] Appl. No.: 781,976

[22] Filed: Mar. 28, 1977

[51] Int. Cl.[2] ..... E05D 17/00

[52] U.S. Cl. ..... 16/197; 16/211; 16/213; 74/230.01

[58] Field of Search ..... 16/197, 198, 210, 215, 16/211, 213, DIG. 31; 49/445, 446; 254/188, 189; 74/230.01, 230.3, 230.05

[56] References Cited

U.S. PATENT DOCUMENTS

| | | | |
|---|---|---|---|
| 126,019 | 4/1872 | Clark | 16/211 |
| 253,005 | 1/1882 | Clark | 16/211 |
| 347,508 | 8/1886 | Phillips | 16/211 |
| 3,055,044 | 9/1962 | Dinsmore | 16/197 |
| 3,358,403 | 12/1967 | Dinsmore | 16/197 X |
| 3,440,683 | 4/1969 | Wood | 16/197 |
| 3,651,704 | 3/1972 | Chapman et al. | 74/230.01 |
| 4,034,616 | 7/1977 | Rauscher | 74/230.05 |

FOREIGN PATENT DOCUMENTS

| | | | |
|---|---|---|---|
| 20,173 of | 1895 | United Kingdom | 16/213 |

*Primary Examiner*—James Kee Chi

*Attorney, Agent, or Firm*—James T. FitzGibbon

[57] ABSTRACT

An improved window sash balance and components thereof. The balance includes a spring fixed with respect to the frame and a pair of pulley blocks, each containing one or more pulleys. One block is fixed with respect to the frame and the other is disposed on the end of the spring. A cord is secured to one pulley block and trained over the pulleys. The other end of the cord terminates in a hook adapted to be received in an opening in the window jamb channel. The pulley block unit includes a pulley-receiving frame, one, two or three pulleys received therein, and at least one axle for rotatably supporting the pulleys within the frame. The block has one or two pulley-receiving openings therein, and suitable openings for reception and positioning of the axle. The block includes first and second pairs of assembly reference surfaces forming a part of the block and spaced radially from the axle opening. The axle-receiving opening in the pulley and in the block each include outwardly tapering guide or pilot surfaces and the axle includes one or two inwardly tapering pilot surfaces. The size of the pulley and the positioning of the reference surfaces are arranged so that when an outer edge of the pulley is in coplanar alignment with the reference surface, the tapering margins on the axle and the pulley will engage and serve to align the pulley as the axles are positioned in the block.

17 Claims, 8 Drawing Figures

SASH BALANCES AND COMPONENTS THEREOF

BACKGROUND OF THE INVENTION

The present invention relates generally to window sash balances, and more particularly, to window sash balances having improved components and subassemblies forming parts thereof.

The invention provides components which are adapted for more economical and rapid manufacture, simplified assembly, and greater reliability in use. The components provided by the invention also have other desirable characteristics, including ease of positioning for installation.

Substantially all windows which open vertically, including both so-called single-hung and double-hung windows, use a balance apparatus of some sort to insure that the window sash will remain in the position in which it is placed by the person manipulating it. While certain low cost window assemblies rely only on friction to maintain the sash in a desired position, the better window assemblies include a balance for this purpose. The balance serves to reduce the effort required to open and close the window, and to move it to a desired position where it will remain supported by the balance.

A number of different types of window balance systems are currently in use, including older systems relying merely on counterbalance weights affixed to the ends of chains or ropes and trained over stationary pulleys. However, with the advent of modern original equipment and so-called replacement windows, there has been a demand for windows which contain high quality balances and which are also capable of ready removal, either partial or complete, from the accompanying window jambs. For example, many windows of today are able to be tilted out of the jamb channels in which they are received for purposes of cleaning. Still other windows are able to be totally removed by a variety of different mechanisms.

Windows of this type must rely on balances which are substantially self-contained. Balances which are suitable for windows of this type tend to become more sophisticated in construction, and have been characterized by the imposition of more exacting standards. In the meantime, there has been a demand for window sash balances and components which are able to be manufactured easily, and which are highly reliable and long lasting in use. Some known window sash balances provide a number of advantages, but these balances include block and tackle or pulley block assemblies which must undesirably be made individually for each set of balances. In such constructions, a pulley block is literally formed around the pulleys after the pulleys are positioned in a machine or the like.

In such constructions, the axles supporting the pulleys are staked or riveted in position after a metal housing is formed and wrapped around one or more pulleys in an operator-controlled machine operation. In such a case, the assembly of pulley blocks or sheaves has required the attention of an individual operator in each stage of manufacture, and accordingly, such designs are not readily subject to automated manufacture.

In addition, other pulley block assemblies of this type are, because of their method of manufacture, made from aluminum or steel. In such cases the possibility of undesirably high friction levels existing between the side plates of the pulley blocks and the balance frame channel constitutes a drawback of the balance assembly.

This is particularly true because, where a coil type spring is used, there must be minimal working clearances between the sides of the pulley block and the interior surfaces of the frame channel to avoid undesirable torsional rotation of the block assembly.

In certain cases, the balance is called upon to support considerable weight, and this in turn calls for pulley supporting axles of significant diameter. As the diameter of the pulley supporting axles increases, the ability to form riveted or flatened heads on the axles easily and at low cost is diminished.

Because balance assemblies of the type with which the invention is concerned are sometimes utilized in unusual positions, or are assembled differently for special purposes, it is also desirable to have a pulley block which is symmetrical in one or more planes, and in which, therefore, either end may be used interchangeably. It is also desirable that the surfaces made in forming the balance pulley block not present sharp corners or radii which limit the ability of the balance to receive a cord or other unit, inasmuch as such sharp edges subject the cord to wear by fraying or the like.

In view of the foregoing and other drawbacks and disadvantages of known types of window sash balances and components thereof, it is an object of the present invention to provide an improved sash balance.

A further object is to provide a sash balance which includes a pulley block component having a number of desirable advantages and characteristics.

Another object is to provide a pulley block assembly for a block and tackle type window balance in which the block itself may be manufactured in a single, relatively simple, high production operation, such as by injection molding the same from a moldable resinous material.

Another object is to provide a sash blance which includes components thereof which are readily adapted for automated or semi-automated assembly.

Still another object is to provide a pulley block for a window sash balance unit wherein the block contains certain reference surfaces which enable the pulleys to be positioned in a desirable position in the block without sacrifice of the working clearances needed for operation of the blanace.

A still further object is to provide a unitary block assembly which is adapted to receive a set of two pulleys in one portion thereof and a single pulley in another portion thereof, and which includes guide surfaces adapted to facilitate positioning of pulleys within the block prior to assembly.

Yet another object of the invention is to provide a block and tackle assembly which includes specially designed pulleys adapted for easy, economical positioning within a pulley block.

Another object is to provide a block and tackle assembly in which the pulleys include beveled or tapered axle-receiving portions and in which the axles include beveled or tapered end portions, both tapers thus providing pilot diameters to aid in assembly of the unit as a whole.

A still further object is to provide a pulley block unit for a sash balance assembly which includes a tapered pilot or guiding surfaces to assist positioning the axle within the pulley block during assembly thereof.

A still further object is to provide a window sash block and tackle assembly which includes a pulley block having additional guide surfaces for aligning the hook or other cord attachment means so as to position the same for easy reception by a slot in the jamb channel of the window assembly.

A still further object of the invention is to provide a one piece, pre-formed pulley block assembly which includes assembly reference surfaces and guide members positioned so as to add strength to the assembled pulley block, and to provide clearance for the cords or tackel used to support the block and the pulleys received therein without interfering therewith in use.

A still further object is to provide a pulley block assembly which is capable of achieving the foregoing and other advantages in use, and which uses the minimum material required consistent with possessing the requisite strength.

Another object of the invention is to provide a pulley block assembly which uses large diameter axle units which are readily positioned and assembled, and which include pilot surfaces arranged so that the axles may be inserted into the block from either side thereof.

A still further object is to provide a pulley block assembly which is symmetrical for purposes of installation along one or more planes, but which still retains characteristic end portions for proper assembly.

The foregoing and other objects and advantages of the invention are achieved in practice by providing a pulley block assembly which includes a frame and surfaces defining a pulley-receiving slot therein, a pulley receivable in the slot, and an axle adapted to extend through an opening in the sidewalls of the block and to support and position the pulley therein, with such units including assembly reference or guide surfaces and various tapers or bevels adapted to permit positioning of the parts for assembly merely by placing them in the desired position against a reference surface and inserting the axle through the opening provided.

The invention is also carried into practice by providing a pulley block assembly which includes guide surfaces for directing the pulley into the pulley-receiving opening, and which may further include surfaces for positioning the hook by reason of engagement between a portion of the guide surfaces and one side of the hook when the balance assembly is positioned for installation.

The manner in which the foregoing objects and advantages of the invention are carried into practice will become more clearly apparent when reference is made to the following detailed description of the preferred embodiments of the invention set forth by way of example and shown in the accompanying drawings, in which like reference numerals indicate corresponding parts throughout.

DESCRIPTION OF THE PREFERRED EMBODIMENTS OF THE INVENTION

While it will be understood that the principles of the invention are applicable to forms of sash balances other than those shown herein, a description of the preferred form of the invention will be given with respect to a sash balance assembly used with a vertically movable window which is positioned for vertical movement within a channel formed in the jamb structure, and in which the sash balance assembly includes a frame in the form of a channel, a coil spring unit supporting a first or movable pulley block, a second pulley block fixed to one end of the channel frame, and a cord trained over the pulleys. The cord terminates at one end thereof in a hook which is adapted to be secured over a holder in the jamb channel, and at the other end thereof in an opening in the movable pulley block.

Figure 1:
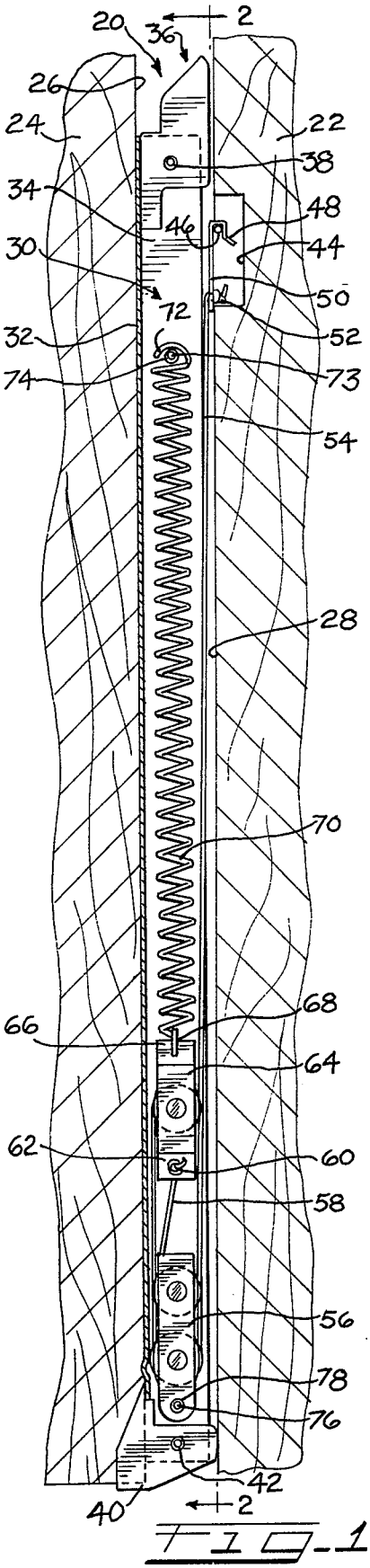
FIG. 1 is a side view, partly in elevation and partly in section, showing a portion of a window sash and a window jamb, with a balance embodying the improved components of the invention shown disposed between the jamb and the sash, and showing the window sash in the lowered position.

Referring now generally to FIG. 1, it will be understood that there is shown only the right hand frame portion of a window assembly, namely, a part of the jamb and a part of the sash, without showing the window pane. A mirror image left hand counterpart of these elements exists on the opposite side of the window, so that the window sash moves in identical jamb channels and is supported by two identical but oppositely directed balance units.

Referring now to the drawings in greater detail, FIG. 1 shows the invention to be embodied in an improved sash greater unit generally designated 20, and shown to be installed in place between a right hand wooden member 22 forming a portion of the window jamb and a left hand wooden member comprising a window sash 24. In use, the balance assembly 20 is disposed in a kerf or cut-out portion generally designated 26 within the sash 24, while the window sash 24 as a whole reciprocates within a channel in the jamb 24 of the window assembly. Thus, it will be seen that the surface 28 shown on the jamb 22 is actually the bottom surface of the channel which serves to locate and establish the plane of movement of the window sash 24 within the window assembly as a whole. As far as placement is concerned, the improved balance of the present invention functions in the same way as prior art balance assemblies.

Referring now to the balance unit 20 in more detail, the balance will be seen to include balance frame means in the form of a channel generally designated 30 and shown to include a bottom or bight portion 32, and a pair of opposed sidewalls 34. Means in the form of an upper profiled sash-attaching fixture generally designated 36 is provided for aid in locking the balance to the jamb when the window sash is removed. The removal fixture 36 is shown to be attached to the frame 30 by fastening means in the form of a rivet 38 extending between the sidewalls 34 of the frame 30. A lower counterpart fixture 40, secured by a rivet 42, is shown to be affixed to the lower end of the frame or channel 30, with such fixture having the normal purpose of centering the window sash with respect to the balances.

FIG. 1 also shows that a small recess 44 is provided in the jamb, and that a hook supporting pin 46 extends transversely across the recess to receive the bight portion 48 of a balance cord hook 50.

As is further shown in FIG. 1, a knot 52 in one end of the balance cord 54 secures the cord to the hook 50. The cord 54 extends downwardly and is trained over the pulleys in the lower or fixed pulley-receiving block 56, and then extends upwardly where the other end 58 thereof is secured as by a knot 60, into an opening 62 in the upper or movable pulley block 64. The upper block 64 includes a nose portion 66 through which a lower hooked end 68 of the balance spring 70 extends. The upper or fixed end 72 of the balance spring 70 extends between opposed sidewall portions 34 of the channel 30 and rests on a support pin 73. Lower pulley block holding means in the form of a pin 76 extends through the openings 78 in the lower or fixed pulley block 56, thus securing it firmly to the sidewalls 34 of the channel 30.

Figure 2:
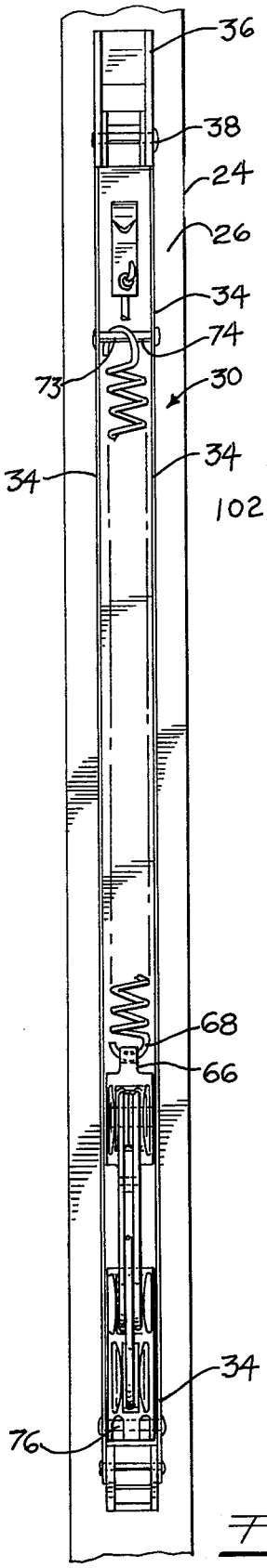
FIG. 2 is a front elevational view of the sash balance of the invention, taken along lines 2—2 of FIG. 1.

Referring now to the operation of the elements of the block and tackle balance, it can be understood by reference to FIGS. 1 and 2 that, with the sash 24 in a lowered position, and the hook 50 in a relatively raised position, the upper or movable pulley block 64 has been pulled downwardly into a position closely adjacent that of the lower pulley block 66, thus extending and tensioning the spring 70. When the window sash 24 is raised, the channel 30 and the elements associated therewith, including the fixed lower pulley block 56, move upwardly, thus shortening the extent of the cord 54 which lies outside the pulley block 56. This, in turn, allows the spring to shorten or relax.

Accordingly, it will be understood that when the sash and balance are installed within the window jamb channel, alternate upward and downward movement of the window sash causes the spring 70 to be tensioned and relaxed and causes the movable pulley block 64 to move upwardly and downwardly with respect to the channel 30, while the lower pulley block 56, the upper spring anchor 74, and the pin 76, all remain fixed with respect to the frame channel 30 of the balance 20.

Figure 3:
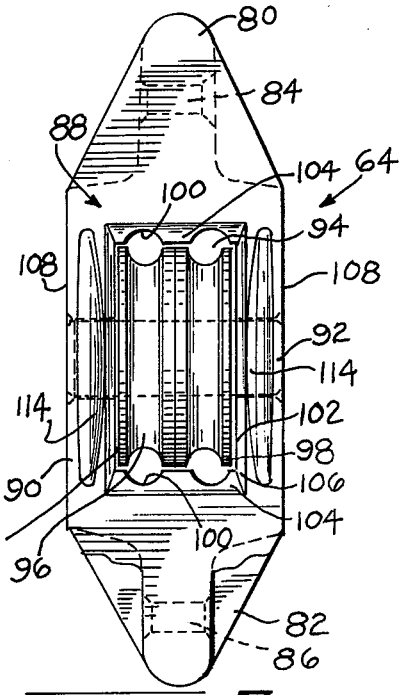
FIG. 3 is an enlarged front elevational view, with portions broken away, showing an assembled form of the movable pulley block made according to the invention.
Figure 4:
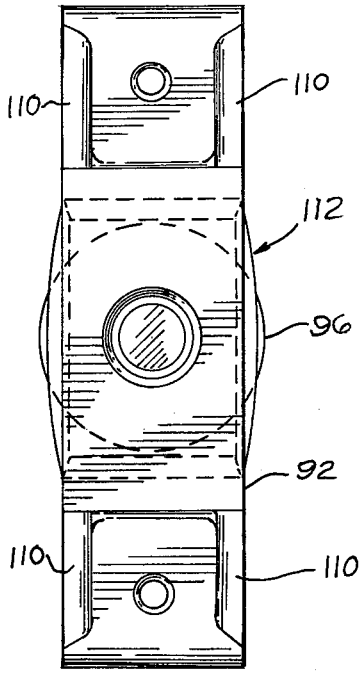
FIG. 4 is a side elevational view of the pulley block assembly of FIG. 3.

Referring now in detail to FIGS. 3 and 4, there is shown the construction of the upper or movable pulley block 64 which, in the illustrated orientating is shown to include an upper or nose portion 80 and a lower or tail portion 82, each including a transversely extending opening 84, 86 for receiving respectively the lower hook 68 on the spring 70 and the other end of cord 54. The pulley block 64 includes a frame generally designated 88, and is shown to include a pair of sidewalls 90, 92 spaced apart and defining therebetween an opening 94 in which are received left and right hand pulleys 96, 98. The opening 94 is partially defined by a pair of end walls 100, which are contoured with circular reentrants to accommodate the cord, and partially by a pair of opposed sidewalls 102.

The pulley-receiving 94 opening also includes beveled end surfaces 104 which join with the end walls 100 and tapered side surfaces 106, which blend into the sidewalls 102.

The outer portion of the block 64 is partially defined by the exterior sidewall surfaces 108 which are parallel to each other and which form the maximum width portion of the block 64. Referring particularly to FIG. 4, it will be noted that pairs of upper and lower tapered reinforcing webs 110 are provided to add stiffness in bending as well as tension to the nose and tail portions 80, 82 of the movable block 64.

In addition to the elements just described, it will be noted that the sidewalls 92 include raised elements generally designated 112 which serve, in a manner to be described in detail later, as assembly reference surfaces for assembly of the pulleys 96, 98. These raised elements 112 also include tapered or beveled inner margins 114 which join the surfaces 106 and which, as will be described in detail, serve to guide the pulleys 96, 98 during insertion thereof into the pulley-receiving opening 94 of the block 64.

Figure 5:
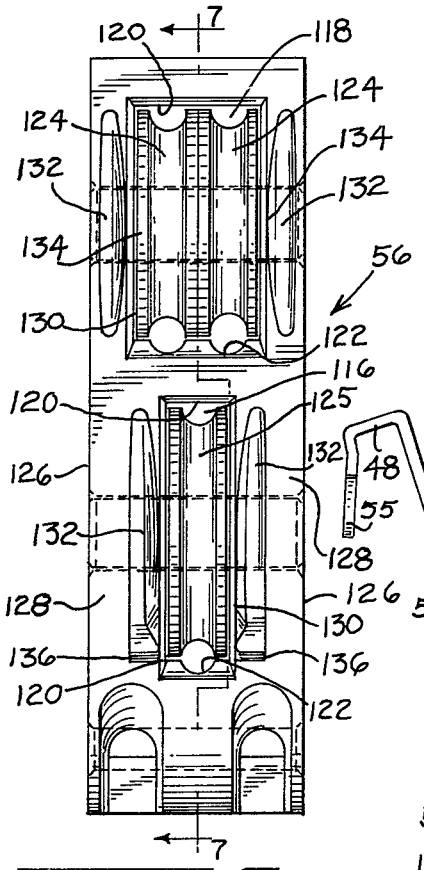
FIG. 5 is an enlarged front elevational view of a preferred form of stationary pulley block of the invention, showing a larger single pulley received in one opening thereof and a pair of smaller pulleys received in the other opening therefor.

Referring now to FIG. 5, there is shown a double pulley block generally designated 56, and shown to include first and second pulley-receiving openings 116, 118, each defined by a plurality of inner end walls 120, some of which include reentrants 122 providing a working clearance for the balance cord. A pair of smaller pulleys 124 are disposed in the upper pulley-receiving opening 118 and a single, larger diameter pulley 125 is disposed in the other opening 116. The parallel exterior sidewall surfaces 126 partially define the sidewall 128, the interior surfaces 130 of which in turn partially define the pulley-receiving openings 116, 118. Opposed parallel pairs of elements 132 are provided adjacent the openings 116, 118, and these elements 132 include downwardly and inwardly beveled guide surfaces 134. In the case of the pair of raised elements 132 shown as the lower pair in FIGS. 5–7, it will be noted that the lower end portions thereof terminate in relatively squared-off shoulders 136, for purposes which will be described later.

Figure 6:
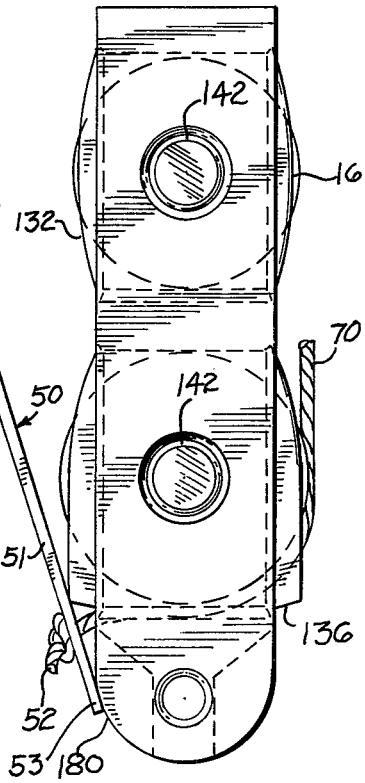
FIG. 6 is a side elevational view of the pulley block of FIG. 5, additionally showing the cord trained over the pulleys and showing the jamb-engaging hook positioned for ready installation.
Figure 7:
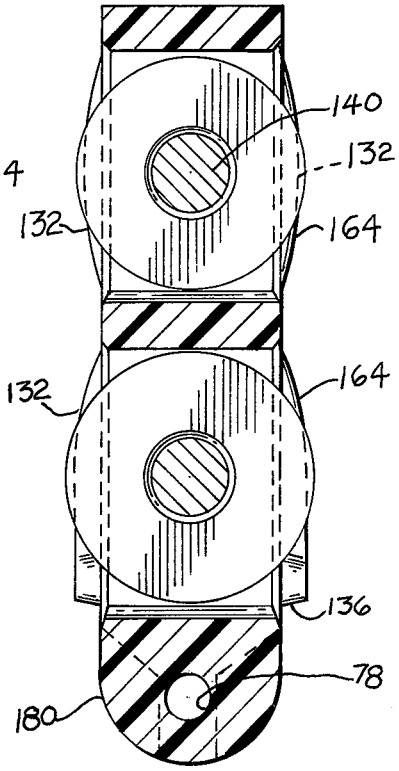
FIG. 7 is a vertical sectional view, taken along the line 7—7 of FIG. 5, and showing portions of the interior of the pulley block of FIG. 5.

FIGS. 5–7 show the opening 78 for receiving the pin 76 (FIG. 1) which holds the block 56 in place within the channel 30. When the block is assembled with the pulleys in place therein, it will be seen that the axles 140 extend through the openings 142 in the block 56, and will retain the pulleys in their desired positions therein.

Figure 8:
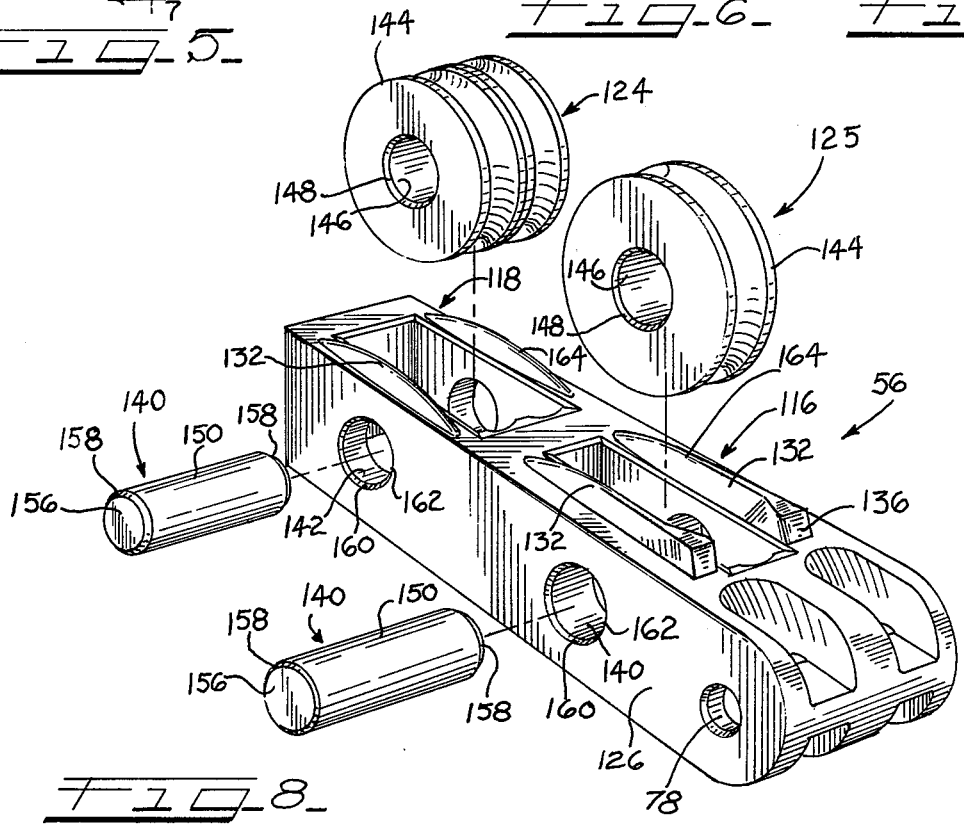
FIG. 8 is a perspective exploded view, showing the manner of assembly of the pulley block of the invention and showing the manner in which the pulleys are inserted into the pulley-receiving openings with the help of the guide surfaces, and showing the manner of inserting the axles in their openings to secure the pulleys in place within the pulley block.

Referring now to FIG. 8, a very important feature of the invention is shown, namely, the greatly simplified manner of assembly of the pulley blocks of the invention. FIG. 8 shows the pair of pulleys 124 of smaller diameter to be positioned above the opening 118, and the larger diameter pulley 125 to be disposed above the single opening 116. Each pulley includes circumferentially extending edge portions generally designated 114, and each pulley 124 also includes an axially extending, axle-receiving opening or bore 146 centrally disposed therein. A beveled surface 148 provides an enlarged diameter lead-in or pilot surface for each pulley 124.

FIG. 8 also shows the orientation of the axles 140 and shows each axle to include a principal or outer diameter surface 150, and an end face portion 156 of a reduced or pilot diameter and shows a taper or bevel 158 extending between the end 156 and outer diameter surface 150.

As is also shown in FIG. 8, a pair of axially extending, axle-receiving sidewall openings 142 are provided, and each opening 142 includes a beveled or tapered surface 160 terminating in an enlarged outer diameter 162.

Referring now to the block 56 itself, the various guide surfaces on the raised elements 132 may be seen, and it will also be appreciated that each element 132 includes surfaces spaced farthest apart from the opening 142 and generally designated 164. These surfaces serve as reference surfaces for assembly in a manner which will now be described.

Bearing in mind that the pulley block of the invention is intended to be adapted for mass production assembly, it will be assumed that the block has been placed in the position shown in FIG. 8 and is resting on a flat surface. Any flat surface thus will extend between those assembly references 132 lying in a common plane, it being understood that the upwardly extending surfaces shown in FIG. 8 have identical counterparts extending on the other side of the block 56, as shown in FIGS. 6 and 7, for example. Inasmuch as the diameter of each of the sets of pulleys 124, 125 is just larger than the distance between opposed pairs of reference surfaces 132, the pulleys, when inserted along the axis shown by the dotted line in FIG. 8, will rest slightly above a vertically centered position with respect to the block.

However, according to the invention, the axles 140, when inserted so as to extend through the axle-receiving openings 142 in the block 56, will have the beveled surfaces 158 thereon engage the counterpart bevel surfaces 148 on the axle-receiving openings 146 on the pulleys. This will cause the pulleys to move relatively downward, or the block 56 to move relatively upward, although the amount of movement will be very slight. The distance will be no greater than the sum of the radial extent of each of the two beveled surfaces. It will also be noted by reference to FIG. 5, that there is also a slight but definite clearance between the end walls 120 of the pulley-receiving openings 116, 118, and that the pulleys, when so received will also inherently be guided from left to right, if necessary, by mutual engagement between the tapers or beveled lead-ins extending between the respective pilot diameters of the parts to be assembled. Consequently, the pulleys are self-centering and self-aligning within the cavity, except to an intentionally small degree, and the slight degree of misalignment is overcome by the provision of the beveled surfaces used for piloting the axle into the pulley and for centering the pulleys within the block 56.

Referring now to another feature of the invention, the downwardly and inwardly extending beveled surfaces on the pulley blocks themselves serve to create, in effect, a funnel or series of guides which insure that the pulleys will find their respective ways into the pulley-receiving openings even though there might be slight misalignment between the holding and indexing means (not shown) from which they are dropped into the pulley block itself. These reference guide surfaces serve not only to facilitate hand assembly, but also automated assembly, inasmuch as the pulleys are guided by gravity and these surfaces into their desired positions of assembly.

A further feature of the invention resides in providing, in the sidewalls 108 or 126, the countersunk, beveled or tapered margins 160 leading into the axle-receiving openings 142 in the pulley block 56. In automated assembly, assuming that the block 56 is being indexed to a predetermined position along an assembly line and subsequently moved longitudinally thereof, and assuming that the axles are pushed into the pulley block in the direction shown by the phantom lines in FIG. 8, it will be understood that these bevels permit minor degrees of axle-to-block misalignment to be tolerated, and that the same self-centering action is provided which is present with respect to the axles and the pulleys. With the various sets of beveled or tapered pilot or guide surfaces, the block may be thus assembled by inserting the axles into the pulley block a predetermined axial distance less than that required to engage the pulleys, subsequently inserting the pulleys in the openings, and thereafter pushing the axles until the faces 160 thereof are flush with the surface 126 of the block 56.

On the other hand, the pulleys and the axles may be inserted at the same station, or the pulleys may be inserted first and the block with the pulleys therein indexed to the axle inserting station. The order of assembly is not important; however, the design is intended to possess the advantages of versatility which reside in optional assembly procedures.

It will also be noted that the pulleys are symmetrical, that the axles are symmetrical, that all the axles and openings therefor are preferably of the same size, with the axles being a light press fit and the housing or block 56 and a slightly looser fit within the pulleys. In a preferred embodiment of the invention, the different size pulleys 124, 125 are color coded so as to facilitate assembly. The single-opening pulley block 64 may move in either direction during assembly, inasmuch as it contains an imaginary vertically extending plane of symmetry in the orientation shown in FIG. 8. The block may also be turned upside down without losing its orientation, and the axles may be inserted from either the right or the left. The double form of block may be inverted, but all blocks of this type must maintain a head-to-tail orientation if the pulleys are fed automatically, because the pulleys are fed singly for opening 116 and in pairs for opening 118.

While the advantages of the pulley block of the invention are best realized by disposing the block 56 in a horizontal position as shown in FIG. 8 prior to assembly, the reference surfaces 132 are arranged in respect to the pulley block body so that a vertically extending wall may also serve as the surface extending coplanar with the outermost edges of these surfaces. Other orientations may be also used, if desired, and the advantages of the invention reside not so much in the preferred orientation of the block upon assembly, but upon the cooperative arrangement of the surfaces and their dispositions so that any object providing a rest or indexing plane will serve to orient the pulleys when such an object is placed in contact with the assembly reference surfaces 132, or surfaces 112 in the case of the block 64.

Referring now to FIGS. 6 and 7, the pair of shoulders 136 are shown to be provided for an additionally advantageous function. When the cord 54 is reeved or trained around the pulleys or sheaves, normally by a hand feeding operation, one end thereof is tied through an opening in the movable pulley and the other end is tied, as by a knot 52, to an opening in the shank 51 of the hook 50.

When the balance assembly is ready to be installed, a certain preload is applied to the hook 50 inasmuch as the spring is initially tensioned to a slight extent during manufacture. Consequently, the end of the cord 54 tends to pull the base portion 53 of the hook towards the block 56.

By disposing the shoulders just above the exit point of the cord, as shown in FIG. 6, the hook may be held in the position of FIG. 6 by reason of the tension on the cord, with an intermediate portion of the hook resting against the shoulder 136 and the base 53 of the hook 50 resting against a rounded corner 180 of the block 56. This positions the hook with the nose portion 55 thereof extending outwardly.

As a consequence, when assembling the window sash and balance combination with the jamb, the hook extends outwardly so as to extend initially into the recess 44 for engagement with the pin 46, against which it will exert a force when the window is raised. It will be understood that the window may be typically installed by inserting it, while raised, into the jamb channel and, as the window is lowered, the hook 50 engages the pin 46 as just described, after which the window is further lowered to its normally closed position. This withdraws the cord to the maximum extent and tensions the spring 70 to the greatest extent.

In the embodiment shown, the cord extends downwardly over one of the uppermost pulleys 124 in the lower block 56, then up and over one of the pulleys 96 in the movable block 64, thence downwardly over the second upper pulley 124 in the lower block, again upwardly over the second pulley 98 in the upper block 64, then downwardly again and around the lower pulley 125 in the lower block 56, then upwardly and out of the frame and toward the supporting pin 46. Accordingly, in a balance which is rigged as shown in FIGS. 1 and 2, five strands are disposed so as to support the movable pulley, and this arrangement provides a mechanical advantage of five to one. While such a feature is not novel per se, a preferred type of balance having a mechanical advantage of four or five to one is advantageous inasmuch as it permits a relatively compact, high rate spring to be used with a long cord; the spring moves only one-fifth or one-fourth as much as the cord moves. This provides a good range of forces for supporting the window throughout a long range of vertical movement. Tranining the cords over a number of pulleys involves a certain frictional loss which is used to advantage, because friction serves to permit the window to remain in any desired position rather than in a single position at which exact balance is achieved.

Referring now to another advantage of the invention, the provision of the guides 132 having the edge portions 132 which serve to position the pulleys during assembly also serve to increase the cross section of the block in the area of the axle openings, thus providing increased strength without loss of material. The upper end of the lower pulley block 56 and the lower end of the movable or upper pulley block 64 are of a reduced extent with respect to the ribbed portions of the block; this provides clearance for the cords so that they do not rub against an end portion of the pulley block. Bearing in mind that the upper block shown in FIGS. 3 and 4 is reversible, both ends are of a reduced extent in relation to the ribs provided for assembly reference and strength.

In the use of the present invention, block and tackle assemblies have been provided which have been shown to tolerate a greater range of loads, to last longer and, very importantly, to be very economical to assemble and to permit assembly by semi-automated or automated techniques. According to the invention, pulley blocks of the type shown herein may be assembled with one-fifth to one-tenth the amount of labor required to assemble prior art pulley block assemblies.

While the type of material used does not constitute a part of the invention which is novel per se, excellent results have been obtained by molding the pulleys from polyamide material such as nylon or an acetal plastic such as "Delrin", and forming the pulley blocks from a reinforced resinous material such as a glass filed nylon (polyamide) resin. The relatively enlarged axles are fitted into the pulleys with only a slight working clearance, and the increased bearing surface provided thereby adds strength, reliability and smoothness in respect to prior art designs utilizing axles which were made as small as possible for ease of staking or riveting.

FIGS. 1 and 2 show the presence of an upper removal fixture 36 and a counterpart lower or centering fixture 40. FIG. 1 shows that both the sash and the jamb are made from wood. However, it will be understood that the fixtures 36 and 40 are shown merely to illustrate the existence of typical accessory hardware which is sometimes used with balances of the invention. The elements shown are not needed for use with the improved balance of the invention, although they are useful therewith, as are other types of accessory hardware. Such hardware is commonly used to provide ready sash removal, either partial or complete, or to provide other functions. Accordingly, it will be understood that the balance of the invention is useful with accessory hardware but is also useful without such hardware.

The illustration of the use of wood is also made merely for purpose of convenience. It is well known to those skilled in the art that a larger variety of window types exist, and these include not only wood windows, but also aluminum windows, coated aluminum windows, steel windows, or windows made from any of the above materials, with or without plastic or other additional materials. The balance of the invention does not depend on what type of windows with which it is used for its utility. However, because of the great versatility the balance of the invention, a single balance design is useful with a large variety of windows, and a very large variety of applications can be served by merely changing the length of balance cord, the length and size of the spring, and the length and crosssectional area of the balance frame or jamb.

It will thus be seen that the present invention provides a novel block and tackle type balance assembly and components thereof having a number of advantages and characteristics including those hereinbefore pointed out and others which are inherent in the invention.

A preferred embodiment of the invention having been described by way of example, it is anticipated that modifications and changes to the type of assembly shown may be made without departing from the spirit of the invention or the scope of the appended claims.

I claim:

1. A pulley block unit adapted for increased ease of assembly and for cooperation, in the assembled state thereof, with a force exerting element to form a window sash balance assembly, said pulley block unit including a pulley-receiving frame, at least one pulley receivable therein, and at least one axle for rotatably supporting said pulley within said frame, said frame having a pair of side walls with exterior wall surfaces and a pulley-receiving opening extending transversely through said pulley block unit and being defined by inner side and end wall surfaces, said inner wall surfaces being joined to first and second pairs of assembly reference surfaces which are spaced apart from each other by the transverse extent of said pulley-receiving opening, an axle-receiving opening disposed in and extending through said side walls and into said pulley-receiving opening, said axle-receiving opening being disposed generally centrally between said pairs of assembly reference surfaces, said pulley having a given diameter and having circumferentially extending outer edge portions and an axle-receiving opening extending therethrough generally centrally thereof, said axle-receiving opening in said pulley including a main diameter portion and an enlarged pilot diameter portion joined to said main diameter portion by a tapering margin extending between said diameters, said axle including a main diameter portion and a reduced pilot diameter portion joined to said main diameter by a tapering margin, said axle and pulley margins, said given pulley diameter, said extent between said pairs of assembly reference surfaces and the distance between said end wall surfaces of said pulley-receiving opening being sized, constructed and arranged so that when said pulley is positioned in said pulley-receiving opening, with said outer edge of said pulley in substantially coplanar alignment with one of said pairs of assembly reference surfaces, said tapering margins on said axle and said pulley will mutually engage each other upon movement of said axle through said side wall and into said pulley-receiving opening and said axle-receiving opening in said pulley, respectively.

2. A pulley block unit as defined in claim 1 which includes two substantially identical pulleys disposed within said pulley-receiving opening, said pulleys being axially aligned and received in use over a common axle.

3. A pulley block unit as defined in claim 1 in which two pulley-receiving openings are provided, with a single axle-receiving opening being provided for said pulley-receiving opening.

4. A pulley block unit as defined in claim 1 which includes two pulley-receiving openings, each opening having its own axle-receiving opening, with a pair of said pulleys being received in one of said openings and a single pulley received in the other opening, said pair of pulleys being received over one of said axles and said single pulley being received over another of said axles.

5. A pulley block as defined in claim 1 in which said inner side wall surfaces defining said pulley-receiving opening include, at the outer ends thereof, tapered guide surfaces tapering outwardly towards said exterior wall surfaces.

6. A pulley block unit as defined in claim 1 in which said inner end wall surfaces defining said pulley-receiving opening further include guide surfaces at the outer ends thereof, tapering outwardly from said side walls.

7. A pulley block assembly as defined in claim 1 in which said frame includes pairs of longitudinally extending ribs disposed radially outwardly of said axle-receiving openings, and wherein said assembly reference surfaces comprise outer edge portions of said ribs.

8. A pulley block assembly as defined in claim 1 in which said frame includes pairs of longitudinally extending reinforcing ribs, said assembly reference surfaces comprising the outermost edge portions of said ribs, said ribs further including, on the inner surfaces thereof, pairs of guide surfaces tapering toward each other and toward said axle-receiving openings, whereby a pulley directed toward said opening will be guided toward said pulley-receiving opening by engagement between the periphery of said pulley and said tapered surfaces.

9. A pulley block unit adapted for increased ease of assembly and for cooperation, in the assembled state thereof, with a force exerting element to form a window sash balance assembly, said pulley block unit including a pulley-receiving frame, at least one pulley receivable therein, and at least one axle for rotatably supporting said pulley within said frame, said frame having means defining at least one pulley-receiving opening in said block, at least one opening in said block for reception and positioning of said axle so that said axle extends through said pulley-receiving opening, first and second pairs of assembly reference surfaces forming a part of said block and spaced radially from said axle opening, said pulley having a given diameter, an outer edge and an axle-receiving opening therein, said opening in said pulley including an outwardly tapering margin, and said axle including an inwardly tapering margin, said axle and pulley margins, said given pulley diameter, and said pairs of assembly reference surfaces being sized, constructed and arranged so that when said pulley is positioned in said pulley-receiving opening, and said outer edge of said pulley is in substantially coplanar alignment with one of said pairs of assembly reference surfaces, said tapering margins on said axle and said pulley will mutually engage each other upon movement of said axle into said pulley-receiving opening and into said axle-receiving opening in said pulley respectively.

10. A pulley block unit as defined in claim 9 which includes two pulley-receiving openings, with each such opening having its own axle-receiving opening, and a pair of said pulleys being received in one of said pulley-receiving openings and a single pulley received in the other of said pulley-receiving openings, said pair of pulleys being received over one of said axles and said single pulley being received over another of said axles.

11. A pulley block unit as defined in claim 9 in which said means defining said pulley-receiving opening include guide surfaces tapering inwardly toward said pulley-receiving opening and adapted to engage outer edge portions of said pulley during insertion thereof into said pulley-receiving opening.

12. A pulley block unit as defined in claim 9 in which said axle-receiving opening in said pulley block frame includes outer guide surfaces which taper toward an enlarged outer diameter, said tapered guide surfaces being adapted for guiding engagement with said tapering margin on said axle during insertion of said axle into said frame.

13. A pulley block unit as defined in claim 9 in which said frame includes pairs of ribs extending parallel to the side surfaces of said pulley, and in which said assembly reference surfaces comprise a portion of the outer edges of said ribs.

14. A pulley block unit as defined in claim 9 in which said assembly reference surfaces comprise pairs of ribs forming squared-off shoulders at one end of said ribs, said shoulders lying adjacent an end of said pulley-receiving opening and being adapted to engage a portion of a sash cord hook so as to position said hook in an outwardly inclined orientation in relation to said pulley frame.

15. A window sash balance assembly comprising, in combination, a sash balance frame, spring means received within said frame, with one end of said spring means being fixed in relation to said frame, a pair of pulley block assemblies disposed within said balance frame, with each pulley block assembly including a frame portion, at least one pulley and at least one axle supporting said pulley for rotation, one of said pulley block assemblies being fixed with respect to said frame and the other being a movable pulley block assembly and having said frame portion thereof affixed to the other end of said spring means, an extensible and retractable balance cord having one end thereof fixed to one of said pulley block frame portion, the other end thereof terminating in means for engaging a portion of a window jamb opening, and an intermediate portion of said cord trained over said pulleys in said pulley block assemblies so as to provide a mechanical advantage in the movement of said movable pulley block assembly relative to said fixed pully block assembly during extension and retraction of said cord, said frame portions of said pulley block assemblies each having means defining at least one pulley-receiving opening in said frame portion, at least one opening in said frame portion for reception and positioning of said axle so that said axle extends through said pulley-receiving opening, first and second pairs of assembly reference surfaces forming a part of said frame portion and spaced radially from said axle opening, said pulley having a given diameter, an outer edge and an axle-receiving opening therein, said axle-receiving opening in said pulley including an outwardly tapering margin, and said axle including an inwardly tapering margin, said axle and pulley margins, said given pulley diameter, and said pairs of assembly reference surfaces being sized, constructed and arranged so that when said pulley is positioned in said pulley-receiving opening, and said outer edge of said pulley is in substantially coplanar alignment with one of said pairs of assembly reference surfaces, said tapering margins on said axle and said pulley will mutually engage each other upon movement of said axle into said pulley-receiving opening and into said axle-receiving opening in said pulley respectively.

16. A balance assembly as defined in claim 15 in which one of said pulley blocks includes two pulley-receiving openings, each such opening having its own axle-receiving opening, a pair of said pulleys received in one of said openings over one axle and a single pulley received in said other opening and received over a single axle.

17. A balance assembly as defined in claim 15 in which said balance frame comprises a metal channel member and in which said pulley block assemblies include frames made from a resinous material which is relatively lubricous relative to said metal balance frame.

* * * * *